United States Patent [19]

Herbet et al.

[11] Patent Number: 5,008,133

[45] Date of Patent: Apr. 16, 1991

[54] METHOD OF COATING A WEB WITH A COATING MIXTURE INCLUDING MICROCAPSULES CRUSHED BY A BACK-UP MEMBER

[76] Inventors: Albert J. Herbet, 6 E. Spring, Oxford, Ohio 45056; Ronald L. Hart, 1650 E. Slater Ct., Xenia, Ohio 45385-9525; Dale E. Work, 115 N. Madison Rd., London, Ohio 43140

[21] Appl. No.: 534,033

[22] Filed: Jun. 6, 1990

[51] Int. Cl.[5] ..... B05D 3/12

[52] U.S. Cl. ..... 427/333; 427/356

[58] Field of Search ..... 427/333, 356

[56] References Cited

U.S. PATENT DOCUMENTS

| | | | |
|---|---|---|---|
| 3,179,536 | 4/1965 | Martinek | 427/356 |
| 3,192,895 | 7/1965 | Galer | 427/356 X |
| 3,674,704 | 7/1972 | Bayless et al. | 264/4 X |
| 4,062,799 | 12/1977 | Matsukawa et al. | 427/333 X |
| 4,524,043 | 6/1985 | McDougal | 264/320 |
| 4,613,526 | 9/1986 | Nakamura et al. | 427/356 |
| 4,756,958 | 7/1988 | Bryant et al. | 428/320.2 |

*Primary Examiner*—Shrive Beck
*Assistant Examiner*—Alain Bashore
*Attorney, Agent, or Firm*—Roy F. Schaeperklaus

[57] ABSTRACT

A method of forming a coating on a web. A coating mixture includes a continuous phase of a first material and a second material contained in microcapsules. The first material and the second material interact to form the coating. The coating mixture is applied to a face of the web. The web is passed between a back-up member and a doctor blade so that the doctor blade levels the coating mixture on the web and crushes the microcapsules to cause mixing of the materials on the web to form the coating on the web.

6 Claims, 1 Drawing Sheet

METHOD OF COATING A WEB WITH A COATING MIXTURE INCLUDING MICROCAPSULES CRUSHED BY A BACK-UP MEMBER

BACKGROUND OF THE INVENTION

This invention relates to the coating of webs of paper and the like. More particularly, this invention relates to a method of applying a coating to a paper web or the like with materials which interact to form the coating.

Such interacting materials can immobilize quickly and are difficult to mix prior to application because of poor rheological flow properties before the materials are in place on the web. An object of this invention is to provide a method of mixing such ingredients when on the web so that the materials do not require delay of interaction between mixing and setting. All known methods, prior to this invention, to immobilize a pigmented coating have suffered from unacceptable rheological flow properties when the interactive ingredients are mixed prior to application. Pigmented coatings that immobilize quickly after application result in a coating with less binder migration, greater coverage of the paper fibers because of lower density, increased opacity and brightness due to more void structure of the coating.

BRIEF DESCRIPTION OF THE INVENTION

Briefly, this invention relates to a method of providing a pigmented coating for a web from interacting ingredients in which one ingredient is included in microcapsules or is microencapsulated and the microcapsules are evenly distributed in a second ingredient which is in a continuous phase. A smooth coating mixture of the continuous phase ingredient and the microcapsules including the other ingredient is applied to a face of the web as by a transfer roll. The web is then passed between a back-up member and a doctor blade. The doctor blade determines the thickness of the coating mixture on the web and causes fracture of the near microcapsules so that the ingredients are mixed in place on the web and the coating sets up in position on the web.

The composition of a pigmented coating usually consists of a well dispersed pigment system, a compatible binder system, additives and water. The coating is applied to paper to improve the optical and printing characteristics of the surface. These characteristics are established during consolidation of the coating and are controlled by pigment and binder characteristics, pigment distribution, pigment orientation and packing, and binder distribution in the dried coating.

The function of a blade coater in applying a pigment coating is to apply an excess amount of coating to the paper, then meter and smooth the coating under the blade. The process of consolidation takes place after the coating has been applied to the paper and consists of removal of the water by penetration into the sheet during application and metering and by evaporation during drying. During consolidation the pigment particles are forced closer together as solids remain behind as removal of water proceeds. Finally, when sufficient water has been removed, the pigment particles begin to touch each other and the system becomes immobilized.

Modern coating technology has established that to obtain optimum coating properties, immobilization of the coating layer should take place immediately after the web has passed the metering blade. Rapid immobilization of the coating has three objectives. First, the coating pigment is maintained on the surface of the sheet to give greater fiber coverage and smoothness. Second, binder migration is reduced which gives a more uniform distribution of the binder in the dried coating and greater coating strength for printing. Third, the dried coating has a more open structure for increased porosity, better optical properties and greater smoothness.

The time required for a coating to become immobilized is determined by the amount of water to be removed (the difference between the amount of water in the coating when applied and the amount remaining when immobilization of solids occurs) and how fast the water is removed from the coating (dehydration rate). Thus, rapid immobilization of a coating can be achieved by increasing the dehydration rate and reducing the water difference between applied and immobilization solids conditions. The dehydration rate is controlled by the type of binder and use of water retention additives. There are two ways to reduce the difference between applied and immobilization solids of the coating. Either the immobilization solids can be lowered (that is, the amount of water that must be removed to reach immobilization is reduced), or the application solids can be increased (that is, there is less initial water to be removed to reach immobilization).

Increased application solids of a conventional coating does not result in an increased void volume in the dried coating. Well dispersed pigment particles in a conventional coating tend to orient themselves with increasing solids in order to minimize interparticle forces. The high level of repulsive forces cause the dispersed particles to pack into a well ordered and tight structure in the dried coating. Thus, this method produces a conventional coating structure with lower compressibility and absorptivity.

Reduction of immobilization solids level will cause an increase in coating structure and is generally achieved by some type of pigment interaction or flocculation. The method uses the addition of chemicals to destabilize or flocculate the dispersed pigment. Flocculated pigment particles form randomly oriented clusters of particles that immobilize at lower solids. The coating dewaters faster with greater void structure in the dried coating.

While improved properties are obtained with the reduction of coating immobilization solids, the potential for blade coater runnability problems is also greater than with conventional systems. This is because a delicate balance must be built into the formulation to enable just enough flow stability to get past the blade—and no more. A flocculated pigment system will give high shear rheological instability such as high viscosity or dilatancy when solids increase with dewatering under the blade. High viscosity and dilatancy causes blade streaks and coat weight control problems. Because of these deficiencies, systems to reduce immobilization solids level by pigment interaction or flocculation have received limited application in the paper coating industry.

The present invention uses encapsulated flocculating chemicals exemplified by polyelectrolytes and high charge cationic polymers to flocculate the pigment system. The chemicals are introduced into the coating by rupture of the capsules with the high pressure and shearing forces developed under the blade tip. The concept has two advantages that resolve the deficiencies of the flocculated system described above. First, the capsules containing the chemical can be added to the coating formulation without destabilizing or flocculating the system before metering at the blade. Thus, the coating will be a well dispersed system until the capsules burst under the blade. This eliminates any runnability problems with the blade. Second, increased void structure can be obtained by immobilizing a low solids coating immediately after the blade. The high shearing forces and pressure under the blade tip bursts the capsules and mixes the flocculating chemical into the coating. This results in flocculation of the coating and rapid immobilization as the coating leaves the blade tip.

A primary application of this invention is the manufacture of coated paper for publication use having improved performance properties. Coated papers produced by this new process of instant immobilization of the coating provides a more porous and structured coating. A method of building "structure" into coatings has been long sought in the industry. Our method allows this to be accomplished simply by modifying the coating formulation. No modification of the coating equipment is necessary as would be required by other methods.

The above and other objects of the invention will be apparent to those skilled in the art to which this invention pertains from the following detailed description and the drawing.

BRIEF DESCRIPTION OF THE DRAWING

The drawing is a schematic view showing a coating machine which includes a back-up roll, a doctor blade arrangement, and means for applying a coating mixture to the web in accordance with the method of this invention.

DESCRIPTION OF PREFERRED EMBODIMENT OF THE INVENTION

Figure 1:
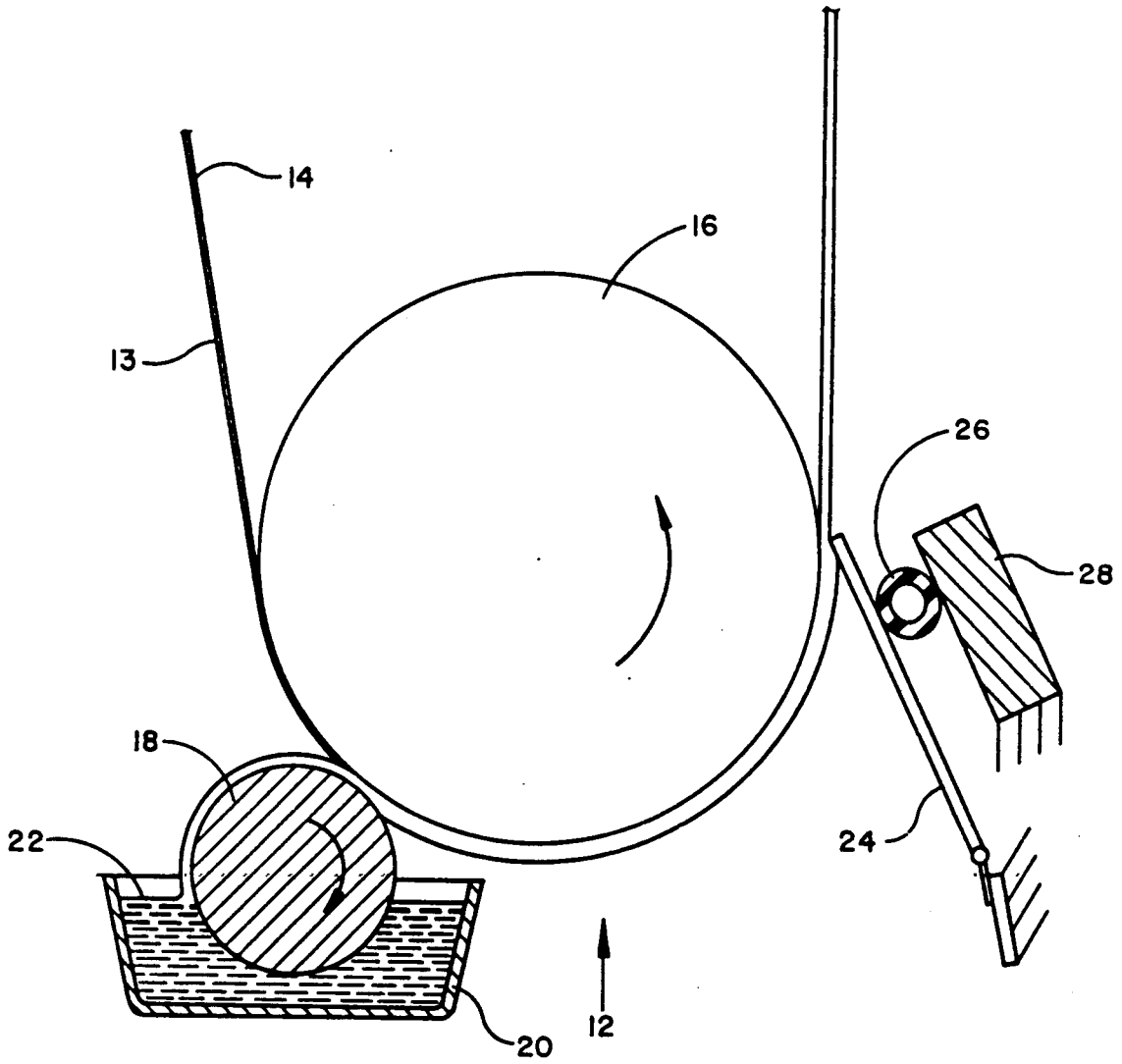

While the present invention will be described more fully hereinafter, it is to be understood at the outset that persons of skill in the art may modify the invention herein described while still achieving the advantages resulting from this invention. Accordingly, the description which follows is to be understood as being a broad teaching disclosure directed to persons of skill in the appropriate arts, and not as limiting the scope of the instant invention.

Microcapsules for coatings can range in size from about 1 to upwards of 50 microns and containing materials desired in capsules having properties as desired in regard to the capsule core and capsule environment by processes well known for many years. Microcapsules ranging in size from about 1 micron to upwards of 50 microns are formed by various methods described in U.S. Pat. Nos. 3,674,704, 4,524,043 and 4,756,958 and literature therein mentioned regarding fabrication of microcapsules.

In the drawing is shown a coating machine 12 for forming a coating on a face 13 of a web 14 in accordance with the method of this invention. The web 14 runs on a back-up roll 16. A coating roll 18 runs in a coating pan 20 to pick up a coating mixture 22 and to apply the coating mixture to the face 13 of the web 14.

The coating mixture can include a continuous phase of a first material which incorporates microcapsules containing a second ingredient surrounded by the continuous phase. A typical example of a coating material can include a coating for the face of the web as the continuous phase and a flocculating material in the microcapsules. An excess of the coating mixture is applied to the web, and the thickness of the coating on the web can be metered by use of a doctor blade 24 which permits only the required amount of the coating material to be carried past the blade by the web. The doctor blade also serves to fracture the microcapsules to release the flocculating material in position in the coating mixture so that the flocculating material is released at the doctor blade. The pressure of the doctor blade 24 on the coating material can be adjusted by introducing compressed air in an air pressure tube 26 which bears on the doctor blade 24 and on a stationary back-up member 28. When the flocculating material interacts with the continuous phase, the coating material is immobilized by the flocculating material to form the coating on the web.

In the coating of paper, it is common practice to apply a coating mixture to a paper web by a coater device, of which there are a variety of constructions. The coating mixture characteristically includes a pigment such as clay, a binder such as latex, starch, or other water soluble binder, an aqueous or other liquid vehicle and other additives as may be desired, and may be applied to a paper web by use of any suitable coater, viz., a device having an applicator transfer roll which picks up the coating mixture from a pan and transfers the coating mixture to the surface of a paper web supported on a backup roll engaging the opposite side of the web. The coating mixture is applied as the web moves through the application station, from which it advances through a doctor blade station in which a doctor blade meters the thickness of the coating as the web passes the doctor blade station. As soon as the coating is applied to the web, water, other liquid components such as a latex binder, and other liquid-carried ingredients of the coating tend to migrate or be carried by migrating portions into the web which absorbs or wicks such liquids into the web where they are in effect withdrawn from the other components of the coating. As a result of the migration of liquid and liquid borne components into the web, the coating not only becomes increasingly less mobile, but undergoes other changes due to loss of portions of other components such as a binder, as it dries while the web moves away from the doctor blade.

The instant invention involves use of a coating which contains a microencapsulated flocculent, the capsules of which are distributed evenly in the liquid coating and are of a size related to the spacing between the doctor blade and the opposed surface of the paper web. The paper web is composed of fibers in a felt-like relation and is thus both porous and has a surface which is not flat but, on the contrary, has surface depressions such that the space between the opposed face of the doctor blade and the face of the web varies due to the nature of the surface of the web. The size of the microcapsules of flocculent are thus preferably of a size small enough to be carried into the space between the paper web and the doctor blade and large enough that they cannot recede into pores of and depressions in the web so as to be carried past the doctor blade without being fractured and broken to release the flocculent to rapidly mix with the balance of the coating liquid under shear forces present in the vicinity of the doctor blade to flocculate the pigment and other flocculatable components of the coating to rapidly produce a structured immobile coating rather than the previous substantially unstructured coatings produced by liquid type coatings which were only gradually immobilized through deliquification and drying. It is accordingly desirable to have the flocculent microencapsulated in microcapsules of dimensions falling within the range of size which will fracture as a result of passage with the web under the doctor blade. In the event the microcapsules are substantially all of a size which do not enter the space between the doctor blade and the web, those capsules of flocculent remain unbroken and are part of the portion of the coating mixture which is diverted by the doctor blade metering of the coating with the result that no flocculent is released in the vicinity of the doctor blade for turbulent mixing under shear forces adjacent the doctor blade and no rapid immobilization or structuring of the flocculatable portions of the coating occurs.

Similarly, when the microcapsules are of a size less than that which results in their fracture in passage under the doctor blade, no release of flocculent through fracturing of the microcapsules under the doctor blade to mix with the coating results, and in such case the undersize microcapsules retain the flocculent in isolation from the flocculatable portions of the continuous phase portion of the coating with which it might otherwise react to structure the coating. Thus the size of the microcapsules has a desirable range related to the evenness or unevenness of the paper web surface and the spacing between the web and the doctor blade such that the desired quantity of flocculent is released and mixed to react with the flocculatable components of the coating. The desirable size range of capsules presently appears to be of a 5 to 50 micron diameter, and preferrably 10 to 25 micron diameter capsules for coated papers comprising on the order of 80% of the current coated paper market volume.

Further, the physical characteristics of the walls of the microcapsules of flocculent have important bearing on the immobilization of the coating as well. Certain physical properties of the wall of the capsule are important to the immobilization of the coating, i.e., the flocculation of the flocculatable components of the coating. In selecting the capsule wall material for use in encapsulating a particular flocculent, care must be exercised to select a wall material that precludes any substantial osmotic exchange or other diffusion of the solute or flocculating material from the capsule core by the external aqueous phase. Further the flocculent must have a sufficiently high molecular weight, viz., 2,000 to 3,000, that it will not diffuse through the capsule wall when the capsules are mixed into the aqueous coating media. If the walls of the microcapsules are too weak, they may tear or otherwise rupture in handling incident to mixing of the microcapsules into the liquid phase portion of the coating and/or in subsequent handling of that coating before it reaches the doctor blade station. Any such deficiency or failure in the wall of the microcapsules would prematurely release flocculent to react with the flocculatale portions of the coating and adversely effect the properties of the coating before it reaches the doctor blade station on the paper. Similarly, if the walls of the microcapsules are strong and tough but deformable, the microcapsules which are otherwise of correct size can deform sufficiently to pass between the doctor blade and web without undergoing rupture and desired flocculation would not occur. Thus, the walls of the microcapsules require strength so as to resist tearing or fracture incident to mixing of the microcapsules with the liquid phase of the coating and in the subsequent handling of the coating mixture to the point where the microcapsules have been applied to the web and reach the vicinity of the doctor blade, and must also be such that it fractures under the conditions present when the web passes the doctor blade.

Toughness and brittleness of the capsule wall can be controlled by controlling the extent of the cross linking of the polymer. The thickness of the wall of the microcapsules is described by the formula:

$$\text{wall thickness} = \frac{d}{2}\left[1 - \left(\frac{100 - P}{P} \times \frac{Cd}{Wd} + 1\right)^{-\frac{1}{3}}\right]$$

where: d=capsule diameter; P=payload (weight percent core); Cd=core density in grams per milliliter; Wd=wall density in grams per milliliter. For a constant microcapsule size, capsule wall thickness is directly dependent upon the ratio of wall material and core material as shown by the equation where "10031 P" is the weight percent wall material and "P" is the amount of core material. For example, the amount of wall material added to the encapsulation media is decreased and/or the amount of core material is increased to produce capsules having thinner walls. To produce capsules with thicker walls, the wall material is increased and/or the core material is decreased.

For 10–15 micron diameter capsules and an 88.8% payload of flocculent, the wall thickness is calculated to be 0.2 to 0.3 microns. Useful wall thickness should be in the range of 0.1 to 0.5 microns for best performance in the practice of this invention as presently preferred.

In addition to the above described characteristics of the microcapsules and the nature of the surface of the paper web, there are a number of additional factors bearing upon the rupturing of the microcapsules and mixing of the released flocculent with the flocculatable portions of the coating incident to the web and coating passing under the doctor blade, and a substantial one of those factors is the nature of the doctor blade involved. Speaking rather generally, doctor blades are sometimes characterized as short or long and thick or thin and stiff or flexible. Doctor blades are normally provided with means for setting and adjusting the pressure of the doctor blade toward or against the web. The blade setting and adjusting means may be a pneumatic tube provided between the doctor blade and a fixed abutment so the blade pressure on the web is increased by or decreased by increase or decrease of pneumatic pressure in the tube, or other adjustment means to regulate the thickness of the coating applied to the web, but in the practice of the present invention, it may also be utilized to adjust the blade pressure to effect both mechanical and hydrostatic and hydrodynamic forces applied to the microcapsules in the coating mixture on the web in the vicinity of the doctor blade. The effect on the microcapsules of such pneumatic adjustment of the doctor blade will vary with the blade characteristics and microcapsule characteristics.

Where the doctor blade is stiff, the hydrostatic, hydrodynamic and mechanical forces applied to the blade by the coating mixture, and possibly the paper web where it contacts the blade, do not cause substantial deflection of the blade, particularly where the blade is short, thick and stiff. On the other hand, where the blade is one characterized as long and thin, under like applied force conditions the blade can flex in a direction away from the web and such flexation would tend to permit pressure under the blade to decrease, but flexation also results in increased area contact between the blade and the coating mixture with the result that the flexible blade may require higher pneumatic pressure in the setting and adjusting tube. Also, the fact that the area of the blade acting against the coating mixture is increased when the blade flexes away from the web, the area of the blade available for microcapsule rupturing contact is also increased, as is the area in which the coating mixture is subjected to shear forces between the blade and the web for mixing of the flocculent and the flocculatable portions of the mixture as well. The fracturing of the microcapsules and the mixing of the flocculent released from the fractured capsules with the flocculatable portions of the coating mixture are influenced by dynamic factors of which the shear forces related to the speed at which the web moves through the doctor blade zone can also have material effect both upon capsule breakage and upon mixture of the flocculent with the flocculatable portions of a coating mixture. The range of such web speeds can extend from as low or lower than 100 feet per minute on a hand operated laboratory test coater through several thousand feet per minute in more sophisticated test equipment and higher speeds in paper making machines in which coaters are often incorporated for the commercial manufacture of coated paper.

For a better understanding of the invention, the following illustrative example will now be given:

EXAMPLE 1

In a 1 liter beaker were placed 280 ml of toluene, 120 ml of 1,1,1-trichloroethane, and 7.6 g of a partially hydrolyzed copolymer of ethylene and vinyl acetate. The contents of the beaker were agitated with a pitched blade turbine impeller fitted to a ⅜ inch diameter shaft connected to a laboratory variable speed stirrer. The contents of the beaker were heated to 95° C. to fully dissolve the polymer and 50 g of safflower oil were added as a phase inducing agent to cause the polymer to phase separate from solution as the temperature is lowered. The temperature of the contents of the beaker were allowed to drop to 45° C.

In a separate container was prepared an aqueous solution of a flocculating agent to be microencapsulated by mixing 30 g of a 50% aqueous solution of cationic polyelectrolyte of low molecular weight, such as Percol 401 (Allied Colloid), and 150 g water. A 1-quart blender jar was preheated to 50° C., and the polymer solution was transferred to the jar. (This amount of core material produces a capsule payload of 14.74 weight percent flocculating agent.) The blender speed was adjusted to obtain dispersed droplets of flocculating agent solution in the size range of 10–15 microns. About six minutes of blending time is satisfactory. The emulsion was transferred back to the 1 liter beaker and agitated.

The emulsion was cooled using an external cold water bath to 16° C. At this point, the suspended droplets of flocculating agent solution were wrapped and engulfed by the separated polymer-rich, viscous liquid phase to form microcapsules. The capsule wall was subsequently crosslinked with a multi-functional isocyante by adding a solution of 20 g Mondur CB-75 (Mobay Chemical) dissolved in 15 g toluene. The temperature of the capsule slurry was then lowered to about 5° C. to densify the capsule wall member. The crosslinking reaction was allowed to continue for several hours while the ice in the bath melted and the temperature gradually rose to ambient.

The capsules now were removed from the water immiscible organic solvent encapsulation media and dispersed in an aqueous latex coating formulation which was applied to a face of a paper web according to the practice described above.

Such removal of the capsules may be accomplished by flushing them from the organic solvent into the aqueous latex using appropriate surfactants. The slurry of capsules is subjected to vacuum filtration to remove as much organic solvent as possible along with dissolved components such as the safflower oil and unreacted isocyanate. The cake is reslurried in an equal amount of toluene and mineral spirits followed by two additional 400 ml washes of mineral spirits.

After the last wash, the filter cake is reslurried in a solution of 7 g of a nonionic surfactant, polyoxyethylene sorbitan trioleate, such as Tween 85, and 100 ml of mineral spirits and mixed well. With stirring, a solution of 100 ml of deionized water and 15 g of a nonionic surfactant, polyoxyethylene sorbitan monooleate, such as Tween 80, is added dropwise. When well mixed, an additional 3 liters of deionized water is added. This slurry is filtered and the cake is washed two additional times with deionized water. Enough water is used each time to achieve a slurry that flows well (as opposed to a paste). Since the capsules begin to swell as water is absorbed into the core, the volume of the cake increases dramatically. The final filter cake of microcapsules has a payload of 2.5% by weight Percol flocculating agent and is ready to mix into a latex formulation of clay for coating onto paper.

Coated papers by a clay-latex slurry of microcapsules produced by this method have shown gloss reductions of 30 to 70% when compared to coated papers produced with the conventional clay-latex formulation. This gloss reduction is believed to be a measure of coating immobilization or flocculation caused by capsule rupture under the blade.

EXAMPLE 2

A batch of microcapsules was prepared using the method of Example 1 except that 10 g of hydrolyzed ethylene-vinyl acetate copolymer and 12 g of the multifunctional isocyanate were added. The microcapsules were much less crosslinked than those of Example 1. Coated papers produced from a clay-latex formulation of these capsules at the same 0.5 wt. % loading of Percol flocculent showed no measurable loss of gloss and no evidence of capsule wall rupture by pressure/shear conditions in the vicinity of the coating blade.

EXAMPLE 3

A conventional blade coating formulation was prepared containing 100.00 dry parts #1 Clay pigment, 12.00 dry parts of a carboxylated styrene butadiene copolymer latex pigment binder for paper and paperboard coatings, such as Tylac 97-820 Latex (Reichhold Chemical Co.), 0.15 dry parts of an alkali activated acrylic associative polymer rheology modifier used at 30% solids and having a pH of 2.5–4.0, thickener, such as Alcogum SL-78 Viscosity Modifier (Alco Chemical Division of National Starch and Chemical Corporation), and ammonium hydroxide to pH 8.0–8.5 to provide a formulation having 60.0% total solids, a Brookfield Viscosity of (#5 ¶ 100 r.p.m.) cp. 1500, to be calendered at 800 p.s.i. at 150° F. at 100 ft./min.

A batch of flocculent containing microcapsules was prepared using the method of Example 1.

The conventional blade coating formulation was divided into three batches. The first said batch of the conventional blade coating formulation was retained as a standard conventional blade coating formulation. The microcapsules were introduced into the second said batch of the conventional blade coating formulation to the level of 0.1 part per 100 parts clay pigment, and into the third said batch of the conventional blade coating formulation to the level of 0.5 part per 100 parts clay pigment.

The three batches of blade coating formulations were for use in connection with high shear coating equipment to investigate the effect that use of the coating under high shear conditions would have on coating immobilization because of increased capsule rupture.

The coater used in the test investigation was a cylindrical laboratory coater manufactured by Sensor & Simulator Products Co., a Division of Weyerhaueser Company, capable of running at speeds of 3500 ft./min. and for the coating experiment, it was operated at 2000 ft./min. While a stiff rigid blade is believed to be the least favorable blade for rupturing microcapsules, the coater had only a stiff rigid blade and it was used. Using each of the three batches of coating formulation, coated sheets were prepared at two coat weights, 8 lbs. and 10 lbs. per 3000 sq. ft. basis weight of paper.

As a result of the coating operation, there were in effect six different coated papers produced; first, papers coated with batch #1 of standard coating formulation at 8 lbs. and 10 lbs. coated weight; secondly, papers coated with the second batch of coating formulation containing a 0.1 part/100 parts of microencapsulated flocculent in both 8 lbs. and 10 lbs. coated weight, and also paper coated with the third batch of coating formulation containing microencapsulated flocculent at 0.5 parts/100 parts at 8 lbs. and 10 lbs. coated weight. Each of the six coated papers thus produced were then divided into three parts. The first part was kept in uncalendered condition, the second part was subjected to 2 nips of calendering at 800 lbs./sq. inch at 150° F. at 100 ft./min., and the third portion was subjected to 4 nips of calendering at 800 lbs./sq. in. at 150° F. at 100 ft./min.

Each of the sub-batches of coated paper were then evaluated as to sheet gloss, IGT pick, brightness, K&N ink absorption, print gloss and porosity properties possessed by them and considered of significance in evaluating coated papers as variations in such properties are indicative of characteristics and qualitites of the respective coated papers. The results of the evaluations may be tabulated as follows:

| | | COATED SHEET PERFORMANCE | | | | | |
|---|---|---|---|---|---|---|---|
| NIPS | MICROEN-CAPSULATED FLOCCULENT LEVEL | SHEET GLOSS | IGT | BRIGHT. | K&N % LOSS | PRINT GLOSS | POROSITY |
| Coat Weight: 10 lbs./3000 Sq. ft. | | | | | | | |
| 0 | 0 | 28.0 | 242 | 75.8 | 31.3 | 44.5 | 100.0 |
| 2 | 0 | 76.0 | 300 | 68.0 | 22.1 | 52.3 | 36.0 |
| 4 | 0 | 79.6 | 242 | 66.6 | 19.2 | 52.2 | 32.0 |
| 0 | 0.1 | 24.7 | 295 | 75.8 | 29.7 | 41.5 | 95.0 |
| 2 | 0.1 | 70.7 | 352 | 71.4 | 25.6 | 52.2 | 53.0 |
| 4 | 0.1 | 78.0 | 393 | 70.2 | 25.2 | 52.2 | 35.0 |
| 0 | 0.5 | 16.9 | 278 | 76.8 | 35.3 | 33.6 | 110.0 |
| 2 | 0.5 | 65.9 | 315 | 72.0 | 28.9 | 46.2 | 80.0 |
| 4 | 0.5 | 69.3 | 343 | 70.7 | 28.7 | 42.1 | 75.0 |
| Coat weight: 8 lbs./3000 sq. ft. | | | | | | | |
| 0 | 0 | 26.3 | 217 | 75.8 | 31.3 | 40.5 | 105 |
| 2 | 0 | 69.7 | 312 | 71.6 | 25.7 | 47.1 | 51 |
| 4 | 0 | 76.7 | 297 | 70.7 | 22.5 | 49.8 | 43 |
| 0 | 0.1 | 23.9 | 280 | 75.7 | 30.4 | 39.4 | 107 |
| 2 | 0.1 | 68.8 | 365 | 71.3 | 27.5 | 53.3 | 80 |
| 4 | 0.1 | 75.2 | 322 | 70.2 | 25.2 | 51.1 | 75 |
| 0 | 0.5 | 16.3 | 268 | 76.0 | 33.8 | 33.3 | 105 |
| 2 | 0.5 | 64.4 | 332 | 72.4 | 27.6 | 46.6 | 85 |
| 4 | 0.5 | 71.5 | 343 | 71.2 | 27.0 | 48.6 | 80 |

The sheet gloss evaluation was evaluation of the specular gloss of the paper at 75°. This is a method of measuring the specular gloss of paper at a 75° angle (15° from the paper). Its chief application is for coated paper. It is measured with a gloss meter which has a source of light, a lens giving a converging beam of rays incident on the test specimen, a suction plate to hold the specimen flat, and a light detector to receive and measure certain of the rays reflected by the test specimen. The unit of measurement is gloss units. The gloss meter is calibrated with a standard gloss specimen, which is traceable to the National Bureau of Standards. A reduction in gloss suggests a more open or porous coating structure since the light is scattered to a greater degree. Since gloss relates to the surface of the coating, it may not be a good indication for the structure of the interior of the coating.

The I.G.T. print strength test is a relative measurement of resistance of the surface layer of a coated sheet to the breakaway of surface fragments of coating when the sheet is separated from the inked plate or blanket in the printing process. It involves the use of an I.G.T. Printability Tester. This has a rotating sector and a printing disk coated with a special constant tack ink. At a selected pressure, the apparatus is accelerated to the point where the ink in the printed area begins to break up due to picking. The distance to this breakup is measured and converted to a value which roughly corresponds to normal printing press speeds in feet per minute.

The brightness test is a method to determine the brightness of paper. It is a numerical value of the reflectance factor of a sample of paper using blue light of special spectral and geometric characteristics. It is read with a brightness tester at 45° illumination and 0° viewing geometry. The illuminating and the viewing beams are adjusted so that the translucent materials are evaluated on an arbitrary but specific scale. The readings are based on the reflectance of sample as compared to the reflectance of a Magnesium Oxide standard.

K&N percentage loss estimates the resistance of a coated sheet of paper to the penetration of ink. It is determined by quickly smearing a thick film of K&N ink, about 1" wide, to the coated specimen with a spatula. After two minutes, the area is wiped with a clean cloth and dried. The brightness of the K&N ink coated specimen is measured and compared to brightness of the base coating. Units of measurement are in K&N percent brightness loss. Higher values for K&N indicate greater ink penetration.

The print gloss test is similar to the specular gloss of paper test. It is used to measure the gloss of a printed area instead of the coating. A specimen of the coated paper is printed with a standard print area with a standard ink. This area is measured for gloss as described above. A reduction in print gloss is an indication of more structure or increased porosity of the surface of a coating.

The porosity effects procedure was developed for the evaluation of the air permeability of porous papers. As applied in this special case, it is used to find the relative porosity of different coatings applied to the same base sheet. With an air permeability tester, the flow rate of air at 23° C. (+/−1° C.) is measured through the coated sheet of paper at a specified pressure drop. The results are expressed as air flow in cubic centimeters per square centimeter of paper. Higher flow rates suggest more structure or openness in the coating. This test will tell if the porosity is more than a surface characteristic since it is measured through the full coated web.

The evaluation data presented in tabular form above indicate significant advantageous improved qualities of coated paper coated in accordance with this invention. The decrease in sheet gloss with corresponding increase in K&N ink absorption imply that the microcapsules were broken under the blade with the released flocculent causing a rapid immobilization of the coating, thereby preventing pigment compaction and/or binder migration, which in turn allowed a porous structure to be formed. Such indication of formation of a porous structure is substantiated by the porosity measurements. The increases in IGT print strength, which is a measure of pick resistance, are indicated for the coatings produced with the encapsulated flocculent. The higher pick resistance values are additional evidence that immobilization occurred rapidly with the result that more binder was retained in the coating matrix resulting in the coating matrix being more strongly bound. The print gloss was not significantly affected. However, a print gloss reduction was apparent in the 10 lb. coat weight with 0.5% encapsulated flocculent level and also corresponds with the higher coating porosity at that level. The coat weight does not appear to be a major contributing factor to the effectiveness of the microencapsulated flocculent since the general trends in the coated paper characteristics are indicated at both the 8 lb. and 10 lb. coat weight. The evaluation of the above data indicates that the use of the microencapsulated flocculent, which is released at the doctor blade under conditions of high shear, rapidly immobilizes the coating and leads to production of a structured coating.

The foregoing description of the specific embodiment will so fully reveal the general nature of the invention that others can, by applying current knowledge, readily modify and/or adapt for various applications such specific embodiment without departing from the generic concept, and, therefore, such adaptations and modifications should, and are intended to be comprehended within the meaning and range of equivalents of the disclosed embodiment. It is to be understood that the phraseology or terminology employed herein is for the purpose of description and not of limitation.

The method of applying a coating to a web, which is described above, is subject to modification without departing from the spirit and scope of the appended claims.

Having described our invention, what we claim as new and wish to secure by letters patent is:

1. A method of forming a coating on a web which comprises forming a coating mixture including a continuous phase of a first material and a second material contained in microcapsules, the first material and the second material being adapted to interact to form the coating, applying the coating mixture to a face of the web, and passing the web between a back-up member and a doctor blade so that the doctor blade levels the coating on the web and crushes the microcapsules to cause mixing of the materials on the web.

2. A method as in claim 1 in which the second material is a flocculating material and, when the second material interacts with the first material, the coating is immobilized on the web.

3. A method as in claim 1 in which the second material is a flocculating material that does not diffuse through the capsule wall and, when the second material interacts with the flocculatable portion of the first material, the coating is immobilized on the web.

4. A method as in claim 1 in which the second material is a flocculating material comprising a polyelectrolyte and, when the second material interacts with the flocculatable portion of the first material, the coating is immobilized on the web.

5. A method as in claim 1 in which the second material is a flocculating material comprising a high charge cationic polymer and, when the second material interacts with the flocculatable portion of the first material, the coating is immobilized on the web.

6. A method of forming a coating on a web which comprises forming a coating mixture including a continuous phase of a first material and a second material contained in microcapsules, the first material and the second material being adapted to interact to form the coating, applying the coating mixture to a face of the web, and passing the web between a back-up member and a doctor blade so that the doctor blade levels the coating on the web and induces shear forces and varying pressures in the coating mixture moving under the blade where the microcapsules rupture and the released second material is rapidly mixed with the first material to form a coating in which at least a portion of the first material is flocculated to immobilize the coating in structured condition on the web adjacent the doctor blade.

* * * * *

UNITED STATES PATENT AND TRADEMARK OFFICE

CERTIFICATE OF CORRECTION

PATENT NO. : 5,008,133

DATED : April 16, 1991

INVENTOR(S) : Albert J. Herbet, et al

It is certified that error appears in the above-identified patent and that said Letters Patent is hereby corrected as shown below:

Title page, item [54] and column 1, Title of invention should read:

--METHOD OF COATING A WEB WITH A COATING MIXTURE INCLUDING MICROCAPSULES RUPTURED ADJACENT A METERING MEMBER--.

Signed and Sealed this

Eighteenth Day of August, 1992

*Attest:*

DOUGLAS B. COMER

*Attesting Officer*

*Acting Commissioner of Patents and Trademarks*